United States Patent [19]

Payson

[11] 4,076,213

[45] Feb. 28, 1978

[54] LOCKING TUBE ASSEMBLY

[75] Inventor: Buford L. Payson, Sun City, Ariz.

[73] Assignee: Robert A. Strauss, Long Beach, Calif. ; a part interest

[21] Appl. No.: 774,254

[22] Filed: Mar. 4, 1977

[51] Int. Cl.[2] ..... A47G 27/04

[52] U.S. Cl. ..... 254/60; 254/62

[58] Field of Search ..... 254/57, 62, 63, 114, 254/116, 119, 106; 285/DIG. 3; 248/188.5, 355, 410

[56] References Cited

U.S. PATENT DOCUMENTS

| | | | |
|---|---|---|---|
| 3,693,936 | 9/1972 | Payson | 254/62 |
| 3,791,624 | 2/1974 | Payson | 254/62 |
| 3,917,225 | 11/1975 | Payson | 254/60 |

*Primary Examiner*—Robert C. Watson

*Attorney, Agent, or Firm*—Fulwider, Patton, Rieber, Lee & Utecht

[57] ABSTRACT

There is disclosed an extendible, locking tube assembly of outer and inner telescoping tubes. The outer tube internally carries a locking collar having an obliquely inclined central aperture that slidably receives an elongated locking member. An end of the elongated member is removably attached to the inboard end of the inner tube. The locking collar has a radial lug that projects exteriorly of the outer tube and bears against an abutment carried on the outside of the outer tube. The locking collar is biased into a position preventing retraction of the elongated member and its dependent inner tube. A lever, attached to the collar, projects exteriorly of the outer tube on the side opposite the abutment, thereby permitting a single-handed release of the locking mechanism. When the assembly is employed, as in its preferred application, with a carpet stretcher, one can release the locking mechanism without shifting one's position from that taken for operation of the carpet stretcher.

7 Claims, 12 Drawing Figures

FIG. 6
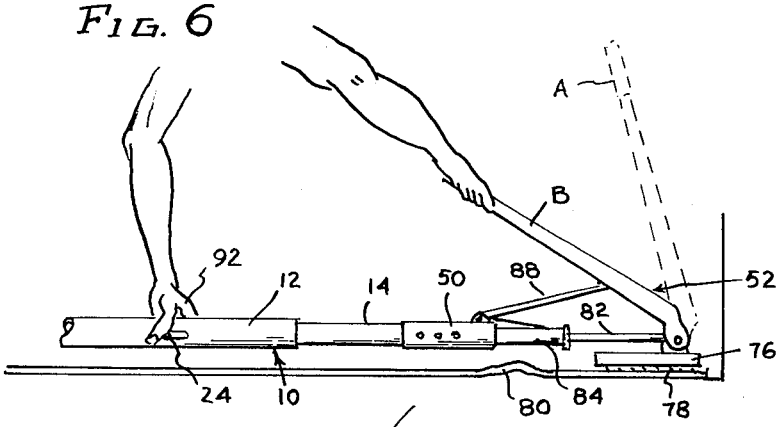
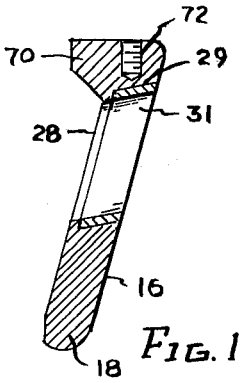
FIG. 12
FIG. 7
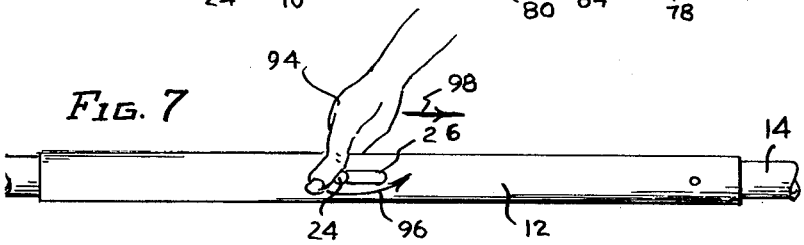
FIG. 8
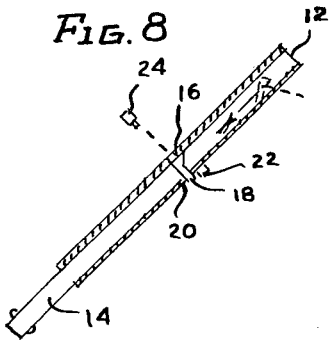
FIG. 9
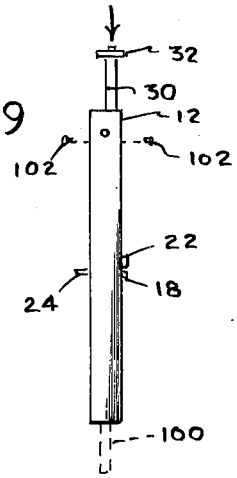
FIG. 10
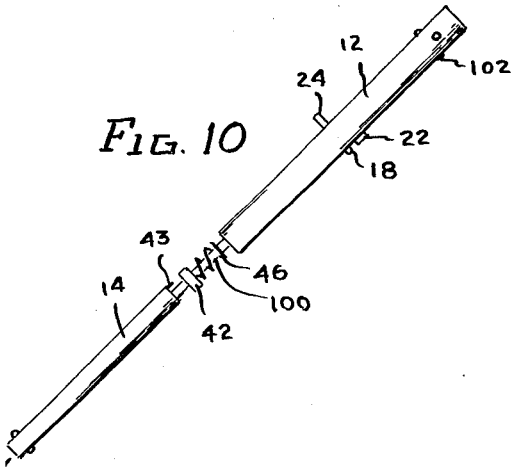
FIG. 11
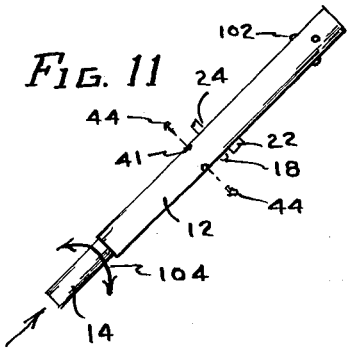

LOCKING TUBE ASSEMBLY

BACKGROUND OF THE INVENTION

1. Field of the Invention

This invention relates to a telescoping and locking assembly of tubular members and in particular to an extendible, locking tube assembly useful with carpet stretchers and the like.

2. Brief Statement of the Prior Art

My prior U.S. Pat. Nos. 3,693,936 and 3,791,624 disclose various extendible, telescoping tube assemblies for carpet stretchers. In the latter patent, I have disclosed and claimed an extendible and locking telescoping assembly of tubular members which can be connected in the otherwise conventional pole assembly used with carpet stretchers. A commercial embodiment of the patented device has been marketed under the designation Magic-Lok to the carpet installation industry.

The patented device is relatively complex having a completely, internally-contained locking collar which is located at the tail end of the assembly and includes an internal push tube linked to an external release lever to move the collar from its locking position. The complexity of this device results in a relatively high cost of manufacture and maintenance particularly since the device cannot be readily disassembled in the field but must be returned to the factory for repair and adjustment. Additionally, the complete containment of the locking collar within the inner tube compromises the lever advantage of the locking collar and limits the maximum loading permitted on the assembly. Finally, the device requires that the operator employ both hands to release and retract the assembly and this usually requires that the operator shift his position from that assumed in operation of the carpet stretcher.

BRIEF STATEMENT OF THE INVENTION

This invention comprises an extendible, locking assembly of telescoping outer and inner tubes. The outer tube supports, in opposite axial slots, a locking collar which has a central aperture obliquely inclined to its face which receives an elongated member therein. The outboard end of the elongated member is removably attached to the inboard end of the inner, telescoping tube. The outer tube also internally carries a retainer surrounding the slidably received elongated member and positioned immediately rearwardly of the collar to support a resilient coil spring which biases the collar forwardly into a position that locks against retraction of the elongated member. The locking collar has a lug that projects through one of the axial slots of the outer tube and bears, in a fulcrumed support for the collar, against an abutment fixedly carried externally on the outer tube. The locking collar also bears, on its opposite side, a lever that projects through the opposite axial slot of the outer tube, permitting one to grasp the outer tube with one's hand about the tube, fixed abutment and lever to permit, in a single-handed motion, the release and retraction of the assembly.

In the preferred embodiment, the unit is constructed for facile field assembly and disassembly and, to this end, the inner tube bears indexing means for the alignment of the spring retainer in the outer tube to permit its attachment internally of the outer tube without any supplemental tool or work fixture.

BRIEF DESCRIPTION OF THE DRAWINGS

The invention will be described by reference to the illustration of which:

FIGS. 6 and 7 illustrate the application of the assembly with a conventional carpet stretcher;

FIGS. 8–11 illustrate the assembly and disassembly of the invention; and FIG. 12 illustrates an alternate lock means.

DESCRIPTION OF THE PREFERRED EMBODIMENTS

Figure 1:
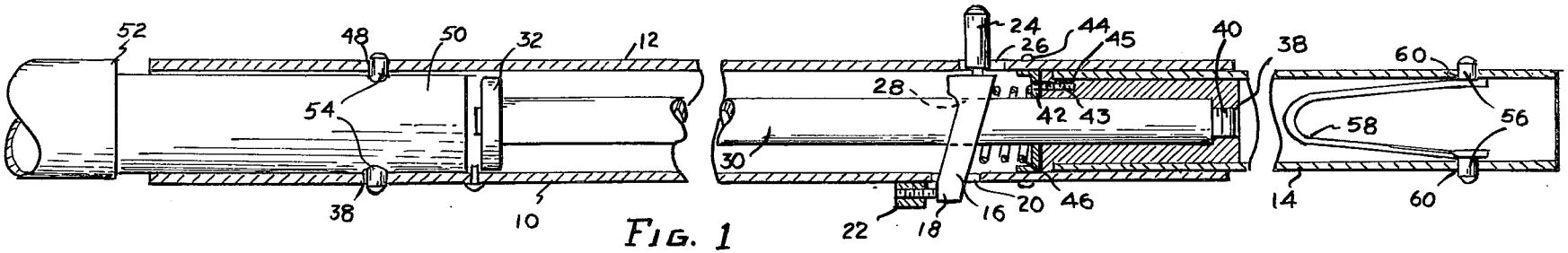
FIGS. 1 and 2 are sectional views of the assembly inretracted and extended positions, respectively.

Referring now to FIG. 1, the invention comprises an assembly 10 of an outer tube 12 and a telescopically received inner tube 14. A locking collar 16 is mounted internally of the assembly with a radial lug 18 that projects externally of outer tube 12 through an axial slot 20 therein. The lug 18 bears against a fixed position abutment 22 carried externally on outer tube 12 to provide a fulcrumed support for collar 16. Collar 16 bears, on its opposite side, a lever 24 which projects through a second axial slot 26 on the opposite side of tube 12. Collar 16 is preferably a steel forging which is case hardened for maximum life.

The collar 16 has a central aperture 28 which slidably receives elongated member 30. Member 30 can be a solid, hard steel rod or, preferably can also be a tubular member which can have a case hardened exterior surface or, most preferably, is formed of heat-treated steel, such as heat-treated 4130 alloy. The member 30 bears, on its inboard end, a fixed position collar 32, and is removably attached, at its opposite end, to inner tube 14. To this end, inner tube 14 bears a bushing 34 on its inboard end which has a central bore 32 to receive the end of member 30. Bore 36 extends only partially into bushing 34 and the latter has an internally threaded counterbore 38 which is turned onto the externally threaded stud 40 on the end of member 30. Bushing 34 has a threaded bore 45 on its inboard face which receives set screw 43. The set screw is normally recessed entirely in bore 45 and is extended therefrom when assembling the unit in a manner described hereinafter.

The assembly also includes resilient means to bias collar 16 into a locking position that restrains retraction of member 30. The resilient means includes a fixed position retainer ring 42 that is fixedly secured to the interior wall of outer tube 12 by fasteners such as screws 44. A resilient helical coil spring 46 is mounted about member 30, restrained between retainer ring 42 and the rearward face of collar 16, biasing this collar forward against fixed abutment 22.

The remainder of the assembly includes means for the removable attachment of the assembly to other tubular members. This comprises the set of apertures 38 at the fore end of the assembly, permitting the assembly to receive a tubular element 50 such as the tail tube of a conventional carpet stretcher 52 and the like which has a pair of opposed, spring biased buttons 54 that seat in apertures 48 when the fore end of the assembly is slipped over the tail tube 50. The aft end of the assembly carries a similar set of spring-biased buttons 56 which are secured to the legs of a generally U-shaped resilient leaf spring 58 and which project through opposite apertures 60, permitting the aft end of the assembly to be similarly secured to a tubular member having mating apertures for receiving the spring biased buttons 56.

Figure 2:
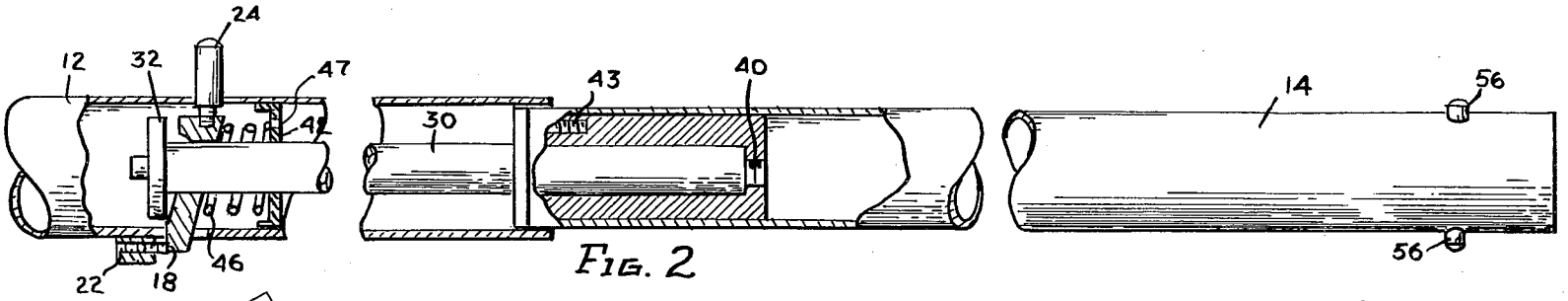

FIG. 1 illustrates the assembly in its most retracted position with the fore end of member 30 and its dependent fixed position collar 32 in proximity to the received end of tail tube 50. FIG. 2 illustrates the assembly in its most extended position with inner tube 14 extended aft to the limit of its travel. This position is obtained by extending tube 14, sliding member 30 through the central aperture 28 of locking collar 16, the limit of travel therein reached when collar 32 abuts against locking collar 16.

Figure 3:
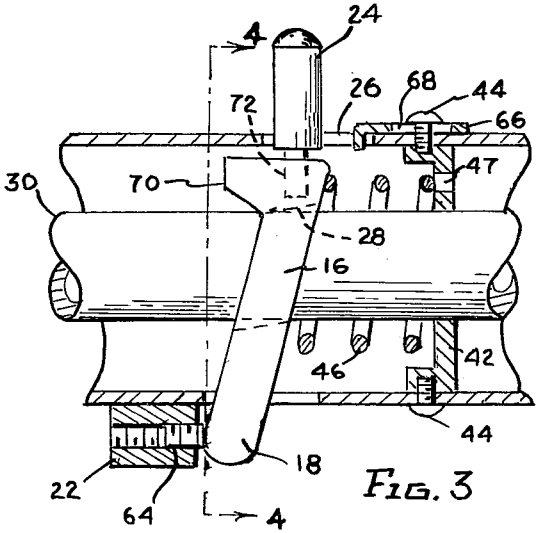
FIG. 3 is a sectional partial view of the locking collar in the assembly.

Referring now to FIG. 3, the locking mechanism of the assembly will be described in greater detail. As there illustrated, the locking collar 16 is secured within outer tube 12 with its lug 18 projecting through the slot 20 and bearing against the end of a set screw 62 that is threadably received in a central, internally threaded aperture 64 of the fixed position abutment 22. The advance or retraction of screw 62 in abutment 22 provides a simple, fixed adjustability of the position of the fulcrum support and thus provides adjustment in the tension of spring 46 accommodating for wear and individual preferences of users.

Lever 24, on the opposite side of collar 16, projects through axial slot 26. Preferably, bracket 66 is secured to the outer wall of tube 12 and projects over axial slot 26 to serve as an abutment stop for travel of lever 24. Also, preferably, the bracket 66 is secured in the assembly with the screw fastener 44 used to secure the spring retainer ring 42 and has an elongated aperture 68 to receive screw 44, thereby permitting the fixed adjustability of the position of bracket 66 and adjustment of the length of free travel of lever 24.

Figure 4:
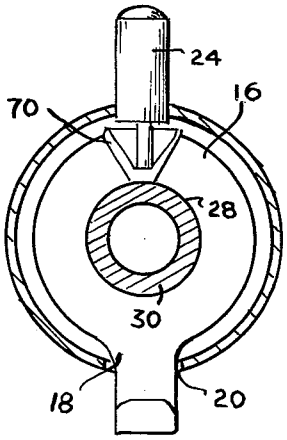
FIG. 4 is a view along line 4—4 of FIG. 3.

Referring now to FIG. 4, the shape and configuration of the locking collar can be seen in greater detail. As there illustrated, the locking collar 16 has a generally circular body with a radial lug 18 that projects through slot 20 of outer tube 12 and rests against the fulcrumed support of screw 63. The central aperture 28 is obliquely inclined to the face of collar 16, at an angle from 5 to about 20, preferably at about 12, degrees, as apparent from the illustration of FIG. 3. The forward face of collar 16 has a raised boss 70 which is tapped with a threaded bore 72 to receive the threaded end of lever 24.

Figure 5:
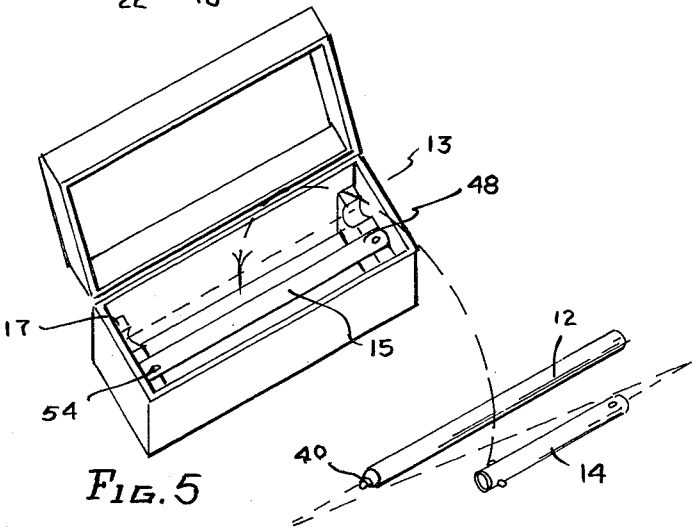
FIG. 5 illustrates the facile packaging of the assembly.

Referring now to FIG. 5, the tubular assembly 10 can be partially disassembled by turning the inner tube 14 to remove it from the threaded engagement with the threaded stud 40 of the slidable member 30. This shortens the overall length of the assembly to that of the outer tube 12, permitting the placement of the tube 12 in conventional cases 13 which have internal lengths of approximately 34½ inches to receive disassembled sections 15 of tubular members with distal inner connecting means such as the previously described spring-biased buttons 54 or 56 and mating apertures such as 48. The shorter inner tube 14 can, of course, be placed within the case 13 while the assembly of the outer tube and locking mechanism can be placed on the support craddles 17 within the box 13.

A feature of the extendible locking tube assembly of the invention is that the locking mechanism can be unlocked and the assembly can be retracted in a single handed motion. This single handed motion can be applied without requiring that one shift one's position from that normally assumed in actuation of a carpet stretcher. This operation is illustrated in FIGS. 6 and 7.

Referring now to FIG. 6, the extendible locking tube assembly 10 is shown in its intended application, coupled at its aft end to a conventional tubular unit which extends to a fixed position support such as a wall block and the like bearing against a wall of a building room. The fore end of the inner tube 14 of the assembly is coupled to the forward tube assembly 50 of a conventional carpet stretcher 52 which has a head 76 with teeth 78 for securing carpet 80. The head is carried on the fore end of a rod 82 that is slidably received within the tubular housing 84 of the stretcher. A hand lever 86 is pivotally mounted on a support carried by the head plate 76. The lever 86 is coupled through link 88 at a pivot point 90, intermediate its length, to the housing 84 such that the raising and lowering of the hand lever 86 will advance or retract the extension of the rod 82 and its dependent head plate 86, permitting the operator to impart the desired degree of tautness to carpet 80.

The carpet installer normally assumes a kneeling position facing the carpet stretcher whereby handle 86 can be grasped and operated with one hand. When the assembly 10 of the invention is deployed with the aforedescribed stretcher, the lever 24 carried on the locking collar projects laterally close to the carpet stretcher, thereby permitting the operator to place his hand on the extendible assembly 10 with a finger or thumb 92 bearing against the lever 24 to permit unlocking of the lever with a single movement of the thumb 92. This simple movement will permit shifting of the handle 86 from a position A shown in the broken lines to the position B shown in solid lines. This movement could be desirable, for instance, when the carpet has been stretched to the maximum tautness. Since the carpet stretcher handle will only lock in its down position, the full travel of the handle cannot be made from position A without exceeding the desired tautness on the carpet. In this position, the operator need only place his free hand on the extendible tube assembly and release the locking assembly by pressing on lever 24, thereby freeing lever 86 for movement by permitting retraction of the extendible tube assembly 10. When the handle reaches the position shown in B, and has it maximum lever advantage, the operator can release the lever 24 which will lock the assembly 10 against any further retraction and the operator can then continue to press handle 86 downwardly into its down, locked position and obtain the desired tautness to carpet 80.

Referring now to FIG. 7, the extendible tube assembly also can be readily retracted by a single-handed motion. This is illustrated with the operator's hand 94 placed over tube 12 of the assembly. In this position the operator's thumb 92 engages lever 24 while the remainder of his hand bears against the fixed position abutment 22 (shown in FIGS. 1–3). The operator then need only swing his thumb 92 through the arc shown by arrowhead line 96 to unlock the tube assembly and then push his hand along the path shown by the arrowhead line 98, retracting the entire assembly. As apparent from the illustration of FIG. 6, this single-handed retraction of the assembly can be performed by the operator without departing from his kneeling position facing the carpet stretcher, thereby greatly contributing to the efficient use of the carpet stretcher, thereby greatly contributing to the efficient use of the carpet stretcher and locking tube assembly.

A further feature of the invention is that the locking tube assembly can be readily disassembled and assembled in the field, thereby permitting repair of the assembly in the field and eliminating costly return of the assembly to the factory for maintenance. FIGS. 8–11 illustrate the steps of assembly of the locking tube unit of the invention. As there illustrated, the steps of assembly comprise temporarily positioning the inner tube 14 within outer tube 12 with its fore end immediately aft of the axial slots 20 and 26 in the outer tube 12. This temporary assembly is tilted at a slight incline and the blocking collar 16 is placed in the open end of tube 12 and permitted to slide down the tube until it reaches its seating position where lug 18 falls through the axial slot 20. The assembler then can mount lever 24 to the collar 16 by engaging its threaded end in the threaded bore in boss 70 of locking collar 16.

Referring now to FIG. 9, member 30 and its fixed position collar 32 are assembled and placed in the forward end of outer tube 12, threading the member 30 through the central aperture of locking collar 16. The assembly is held in an upright position to permit the aft end 100 of tube 30 to project from the aft end of tube 12. The member 30 can be secured in the assembly by seating screws 102 in threaded apertures on opposite walls of the outer tube 12. The screws 102 are of sufficient length to project radially inwardly of the tube and serve as stops against the forward face of collar 32.

The next step in the assembly is illustrated in FIG. 10. This comprises placing the coil spring 46 over the extended end 100 of the member 30, followed by the retainer ring 42. In the assembly, it is necessary that the retainer ring 42 be adjusted in its axial as well as angular position within outer tube 12 to permit securing the retainer ring to tube 12 with the screw fasteners 44. This is accomplished without the use of any extraneous jig or tool by extending the previously described set screw 43 from its recessed position within the threaded bore 45 on the forward face of bushing 34. The retainer ring is placed over the forward face of bushing 34 so that the extended end of set screw 43 projects through aperture 47 in ring 42, thereby interconnecting the retainer ring and the inner tube 14.

Referring now to FIG. 11, the inner tube 14 is slipped into the outer tube 12 to engage the spring 46 against the rear face of the locking collar 16. The tube 14 is thereafter moved to compress spring 46 and is rotated as shown by the arrowhead line 104 until the threaded apertures in the annular rim of the retainer ring 42 can be observed through the holes 41 of outer tube 12. Thereafter the screws 44 can be turned into threaded engagement with the threaded apertures of the annular retainer ring 42, completing the assembly of the locking mechanism. Tube 14 can then be retracted from the tube 12 and set screw 43 can be turned into its recessed position in the bushing 34. The inner tube 14 can be replaced in the assembly, seating the member 30 in bushing 34 and, in this position, the inner tube 14 can be turned to threadably engage the member 30.

The disassembly of the extendible tube unit can be readily accomplished by reversing the aforedescribed assembly steps. The first step of disassembly comprises the removal of the inner tube 14. Therafter the screws 102 are removed from the outer tube and the release lever 42 is moved while holding the unit in an inverted position to permit the member 30 with its collar 32 to drop from the lowered, fore end of the unit. The inner tube 14 is then reinserted and pressed against the rear face of the retainer ring 42, relieving the spring force on the screw fasteners 44. The screw fasteners are then removed and the retainer ring 42 and coil spring 46 can be dropped out of the aft end of tube 12. The locking collar can then be removed by disassembly of the released lever 24 and tilting the fore end of tube 12 downwardly to permit the collar to fall from the tube.

Referring now to FIG. 12, there is illustrated an alternative construction for locking collar 16. This collar is substantially identical to that previously described and illustrated in FIGS. 3 and 4, except that bore 28 has a counterbore 29 to provide an annular seat which receives bushing 31 in a press fit. Bushing 31 is formed of an alloy steel, e.g., of 4130 alloy and is heat treated for maximum hardness. This permits forming of collar 16 of any suitable material, e.g., of cast steel while providing surfaces of maximum hardness in bushing 31 to engage the elongated member 30.

The entire disassembly and assembly of the unit requires only the use of a screw driver and allen wrench and can be accomplished in a few minutes, thereby permitting facile replacement of any of the components of the unit.

In its preferred embodiment, the extendible unit has a length permitting storage of its outer and inner tubes within a conventional tube case of 34½ inches as shown in FIG. 5. The unit can be extended, and automatically locks at any of a infite number of extensions, up to a maximum extension from 31 to about 15 inches.

The invention has been described with reference to the illustrated and presently preferred embodiments thereof. It is not intended that the invention be unduly limited by this description of preferred embodiment. Instead, it is intended that the invention be defined by the means, and their obvious equivalents, set forthin the following claims.

I claim:

1. An extendible locking tube assembly for attachment to a carpet stretcher comprising:

an outer tube bearing first and second longitudinal slots on opposite sides, intermediate its length;

a locking collar member received within said outer tube having a central aperture on an axis obliquely inclined to the face of said collar member;

a locking member slidably received within said central aperture;

a radial lug projecting from said collar member and extending through said first slot;

abutment means carried on said outer tube forward of said first slot and bearing against the forward face of said radial lug to provide a fulcrum for said collar member;

lever means carried by said collar and projecting through said second slot;

retainer means fixedly carried within said outer tube;

resilient means captured between the rear face of said collar member and said retainer means;

an inner tube slidably received within said outer tube and removably attached to the rear end of said locking member; and attachment means distally carried by said assembly for attachment in a carpet stretcher assembly with said first and second longitudinal slots in a horizontal plane whereby said abutment means and radial lug can be grasped to release said locking means and retract said assembly with a single-handed motion.

2. The extendible locking tube assembly of claim 1 wherein said abutment means comprises a boss externally carried on the wall of said outer tube and having an axial, threaded bore receiving set screw means projecting from the rear face thereof to serve as a fixedly adjustable fulcrum support for said radial lug of said locking collar.

3. The extendible locking tube assembly of claim 1 wherein said resilient means comprises a compression coil spring.

4. The extendible locking tube assembly of claim 1 wherein said inner tube distally carries, on its inboard end, a bushing having a central bore to receive the end of said locking member and a threaded counterbore to threadably engage a stud carried on the end of said member.

5. The extendible locking tube assembly of claim 1 wherein said attachment means are distally carried by both said outer and inner tubes for removable attachment to mating tubular members.

6. The extendible locking tube assembly of claim 5 wherein said attachment means comprises a pair of apertures in the end of one of said outer and inner tubes and a pair of spring biased, radially projecting buttons distally carried by the other of said tubes with both said apertures and buttons being in said horizontal plane.

7. The extendible locking tube assembly of claim 1 wherein said inner tube eccentrically bears axially extendible means for engagement with a mating eccentrically located aperture in said retainer means, permitting said inner tube to be employed as a tool for axially and rotationally positioning said retainer means in said outer tube during assembly of said locking tube assembly.

* * * * *